US007712696B2

(12) United States Patent
Loh

(10) Patent No.: US 7,712,696 B2
(45) Date of Patent: May 11, 2010

(54) CABLE COILING METHOD AND APPARATUS

(75) Inventor: Yee Boon Andrew Loh, Singapore (SG)

(73) Assignee: Creative Technology Ltd, Singapore (SG)

( * ) Notice: Subject to any disclaimer, the term of this patent is extended or adjusted under 35 U.S.C. 154(b) by 1241 days.

(21) Appl. No.: 11/252,454

(22) Filed: Oct. 17, 2005

(65) Prior Publication Data

US 2007/0086617 A1 Apr. 19, 2007

(51) Int. Cl.
*B65H 75/28* (2006.01)
*B65H 75/40* (2006.01)

(52) U.S. Cl. ..... 242/360; 242/437.4; 242/475.7; 242/475.8; 242/916; 24/115 R

(58) Field of Classification Search ..... None
See application file for complete search history.

(56) References Cited

U.S. PATENT DOCUMENTS 1,591,105 A * 7/1926 Rolland ..... 280/480
3,275,969 A * 9/1966 Sheeran ..... 439/451
3,363,293 A * 1/1968 Nemrod et al. ..... 24/30.5 P
4,182,005 A * 1/1980 Harrington ..... 24/16 PB
4,802,638 A * 2/1989 Burger et al. ..... 242/388.1
4,940,427 A * 7/1990 Pearson ..... 439/501
4,942,617 A * 7/1990 Boylan ..... 381/182
5,075,932 A * 12/1991 Hunt et al. ..... 24/16 PB
5,329,592 A * 7/1994 Altman ..... 381/379
5,422,957 A * 6/1995 Cummins ..... 381/384
5,507,667 A * 4/1996 Hahn et al. ..... 439/501
5,706,353 A * 1/1998 Arai et al. ..... 381/77
5,722,854 A * 3/1998 Geisler ..... 439/528
5,732,445 A * 3/1998 Stodolka et al. ..... 24/16 R
6,011,686 A * 1/2000 Grasso et al. ..... 361/679.09
6,222,128 B1 * 4/2001 Gretz ..... 174/72 A
6,499,199 B2 * 12/2002 Frazier ..... 24/306
6,523,229 B2 * 2/2003 Severson ..... 24/16 PB
6,536,719 B2 * 3/2003 Rivera ..... 248/74.3
6,712,320 B2 * 3/2004 Rivera ..... 248/74.3
6,746,272 B2 * 6/2004 Bean ..... 439/501
6,834,820 B2 * 12/2004 Wei ..... 242/378
D506,744 S * 6/2005 Andre et al. ..... D14/205
6,912,291 B2 * 6/2005 Huang ..... 381/374
7,077,363 B2 * 7/2006 Rivera ..... 248/68.1
D566,107 S * 4/2008 Bowling ..... D14/223
D583,362 S * 12/2008 Hsu et al. ..... D14/205
2003/0167605 A1 * 9/2003 Schultz ..... 24/306
2003/0169896 A1 * 9/2003 Kirk et al. ..... 381/370
2004/0159735 A1 * 8/2004 Wei ..... 242/378.3
2007/0165371 A1 * 7/2007 Brandenburg ..... 361/683
2008/0149797 A1 * 6/2008 Yang et al. ..... 248/311.2

* cited by examiner

*Primary Examiner*—Jack W. Lavinder

(57) ABSTRACT

A method (200) for coiling an earphone set (10) comprising at least one earphone (11), at least one cable (12), one for each earphone (11), and a connector (14), the method comprising:

coiling the at least one cable (12) around a cable strap (21) having at least one end (22);

passing a first (22) of the at least one end of the cable strap (21) over a first (11) of the earphones by inserting the first earphone (11) through a first slot (23) in the first end (22) for attaching the first earphone (11) to the cable strap (21); and passing a second (22) of the at least one end of the cable strap (21) over a second (11) of the earphones by inserting the second earphone (11) through a second slot (23) in the second end (22) for releasably attaching the second earphone (11) to the cable strap (21).

16 Claims, 11 Drawing Sheets

CABLE COILING METHOD AND APPARATUS

FIELD OF THE INVENTION

This invention relates to a cable coiling method and apparatus and relates particularly, though not exclusively, to a cable coiling method and apparatus for storing an earphone.

BACKGROUND OF THE INVENTION

As portable technology advances consumers demand portable devices be easy to use. This demand also extends to the use of their accessories, such as, for example, earphone sets, hands-free sets, button headphones, and so forth.

Most such accessories are separate from and releasably attachable to the portable device. To keep them in order, separate cable-control apparatus is used. Such cable-control apparatus is normally bulky and can be cumbersome to use. For example, as shown in FIG. 1, a conventional earphone set 10 comprises two earphones 11, an earphone mount 18 attached to each of the two earphones 11, a cable 12, a first end of the cable 12 splitting to form two cable extensions 13. Each cable extensions 13 is attached to a first end 17 of the earphone mount 18. A jack 14 is attached to a second end 19 of the cable 12, wherein the jack 14 may be inserted into a socket 15 of a portable device 16 such as, for example, an MP3 player.

Traditional cable management solutions for earphones 11 may be such as, for example, a cable spooling casing 15 wherein the cable 12 is winded in the casing 15. The casing 15 comprises a plurality of slots 16 for securing the earphones 11, a bottom case 17 and a cover 18 attached to the bottom case 17. This is cumbersome to set up, and is quite bulky.

SUMMARY OF THE INVENTION

In accordance with a first preferred aspect there is provided a method for coiling an earphone set comprising at least one earphone, at least one cable, one for each earphone, and a connector, the method comprising:

coiling the at least one cable around a cable strap having at least one end; and passing a first of the at least one end of the cable strap over a first of the earphones by passing the first earphone through a first slot in the first end for releasably attaching the first earphone to the cable strap.

There may be two earphones and two cables. The method may further comprise passing a second of the at least one end of the cable strap over a second of the earphones by passing the second earphone through a second slot in a second end of the at least two ends for releasably attaching the second earphone to the cable strap.

According to a second preferred aspect there is provided apparatus for coiling an earphone set comprising at least one earphone, at least one cable, one for each earphone, and a connector, the apparatus comprising a cable strap for coiling the at least one cable, the cable strap comprising at least one end;

a first of the at least one ends has a first slot for passing over a first earphone of the at least one earphone by passing the first earphone through the first slot for attaching the first earphone to the cable strap;

wherein the earphone set is releasably secured to the cable coiling apparatus after the at least one cable is coiled.

The cable strap may be of an elastic material selected from a group consisting of: vinyl, leather, butyl, and neoprene.

Each slot may comprise a slit extending from each slot, the slit being for enabling expansion of each slot. Each slot may have a defined shape selected from the group comprising: a circle, a triangle, a quadrilateral, and a polygon.

The first end may be detachably attached to the second end via a fastening device selected from a group consisting of: Velcro, press-studs, zips and snaps. Each slot may comprise a slit extending from each slot, each slit being for enabling expansion of each slot.

The first end may be affixed to the second end; and the cable strap may comprise a sleeve for securing the cables. The earphone set may be affixed to the cable strap; or may be detachably attached to the cable strap.

There may be two earphones and two cables, the cable strap comprising two ends and further comprising a second slot at a second of the two ends for enabling the cable strap to be passed over the second of the earphones by passing the second earphone through the second slot to releasably attach the second earphone to the cable strap.

BRIEF DESCRIPTION OF THE DRAWINGS

In order that the present invention may be fully understood and readily put into practical effect, there shall now be described by way of non-limitative example only preferred embodiments of the present invention, the description being with reference to the accompanying illustrative drawings.

In the drawings.

DETAILED DESCRIPTION OF THE PREFERRED EMBODIMENTS

Figure 1:
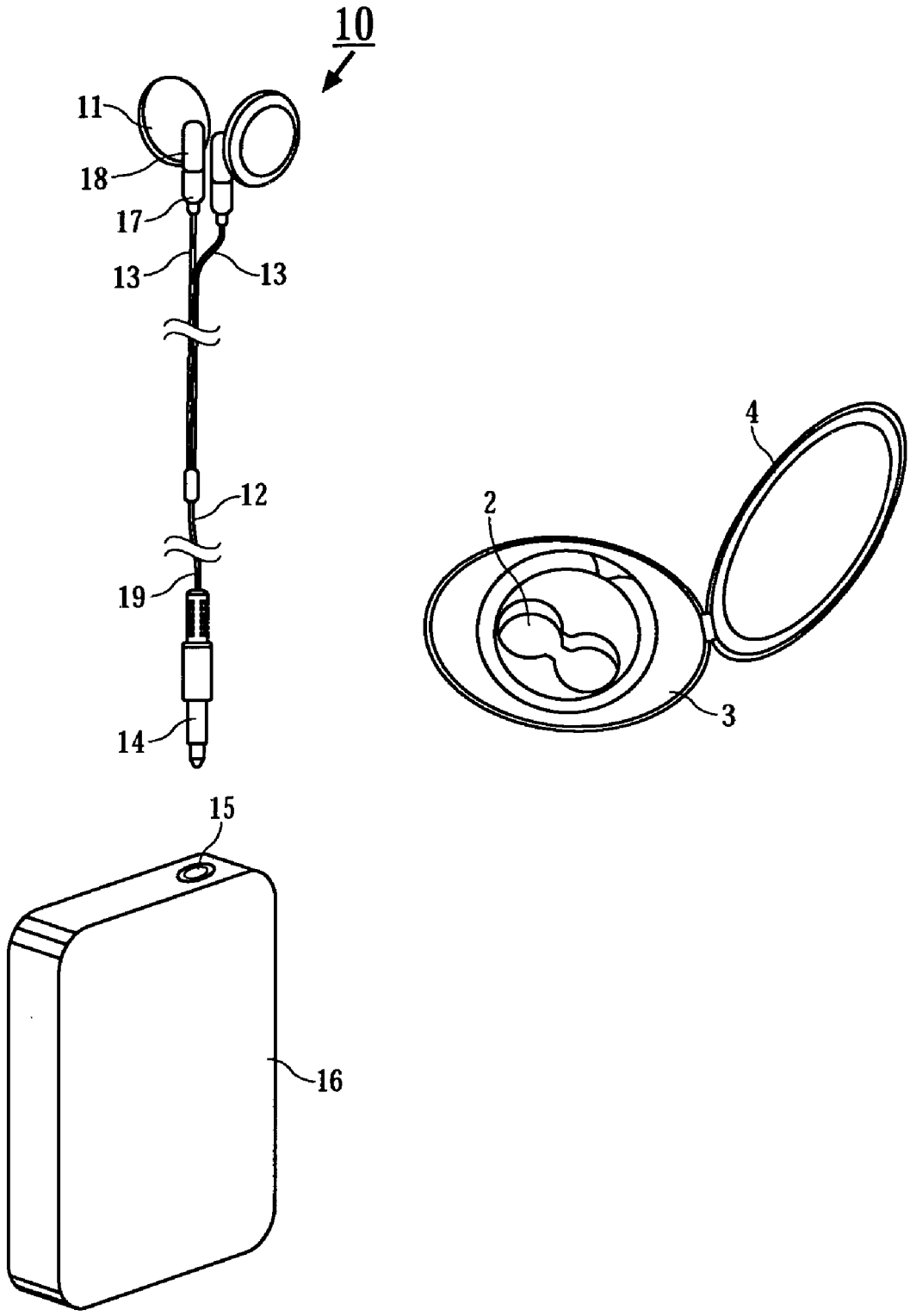
FIG. 1 (PRIOR ART)
FIG. 1 illustrates a top view of a prior art cable spooling casing for earphones for a portable device.
Figure 2:
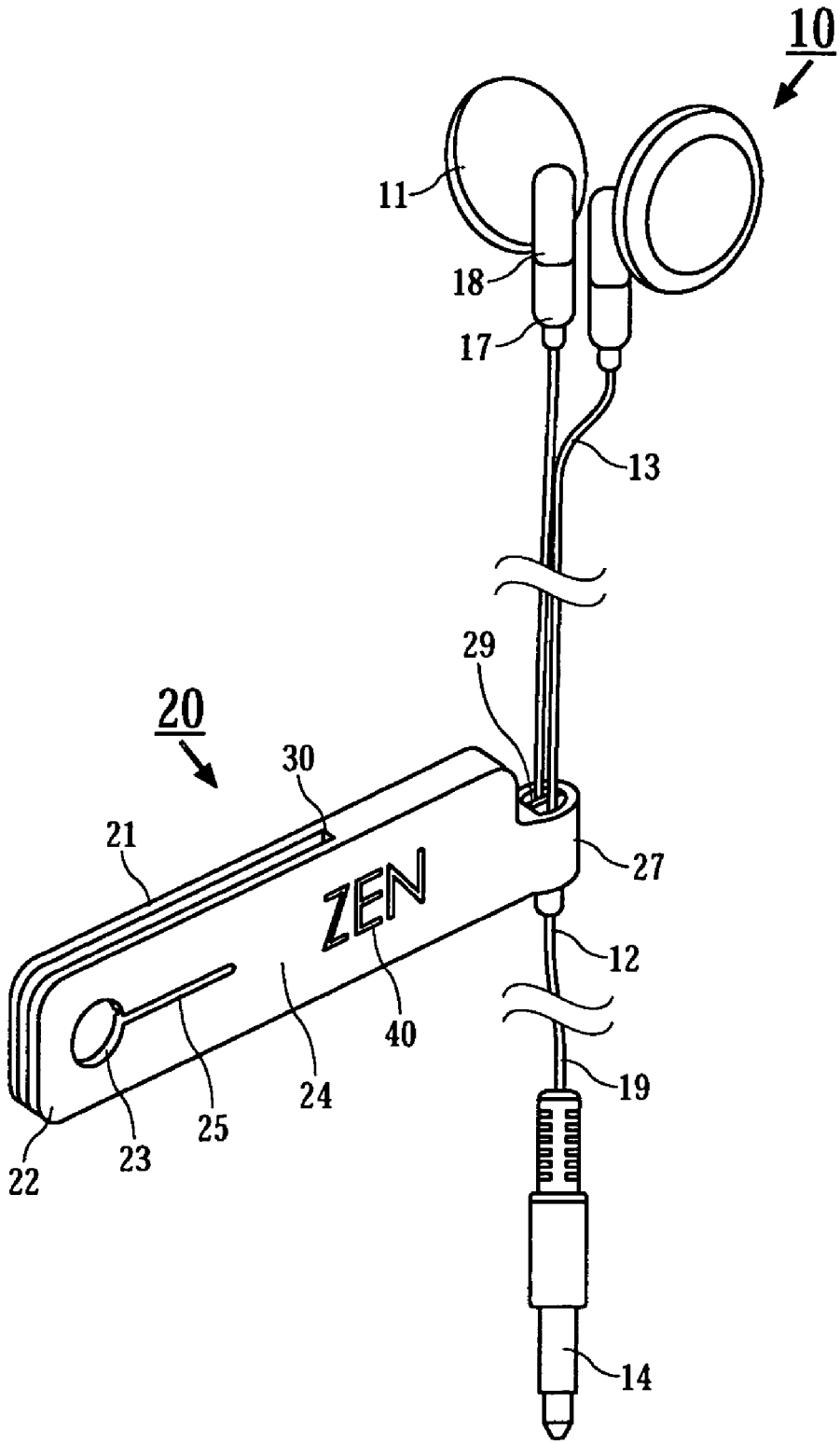
FIG. 2 illustrates a perspective view of a cable coiling apparatus according to a first preferred embodiment.

FIG. 2 shows a cable coiling apparatus 20 for securing an earphone set 10 to the cable coiling apparatus 20 according to a first embodiment of the invention so that the earphone set 10 is in a relatively compact configuration for ease of storage and transport. The apparatus 20 comprises a cable strap 21 for coiling the cable 12 around a first portion 24 of the cable strap 21. The cable strap 21 is split at a joint 30 to form two ends 22, each end 22 comprising a slot 23. The slot 23 comprises a slit 25 extending adjacent from the slot 23. The slot 23 may be of a shape such as, for example, a circle (as shown), a triangle, a quadrilateral, a polygon and the like. The slit 25 may be of a shape such as, for example a horizontal cut-out. The cable strap 21 may be made of an elastic material such as, for example, leather, vinyl, butyl, neoprene or any suitable types of polymers.

A sleeve 27 of the cable strap 21 is for securing each of the cable extensions 13 in place. The apparatus 20 may be attached to the earphone set 10 during the manufacture of the earphone set 10. A rib 29 formed within the sleeve 27 prevents the apparatus 20 from moving down towards the jack 14. A primary logo 40 may be printed onto the first portion 24. The primary logo 40 may be printed by a process such as, for example, silk screen printing. The primary logo 40 may also be indented or embossed onto the first portion 24 of the apparatus 20.

Figure 3:
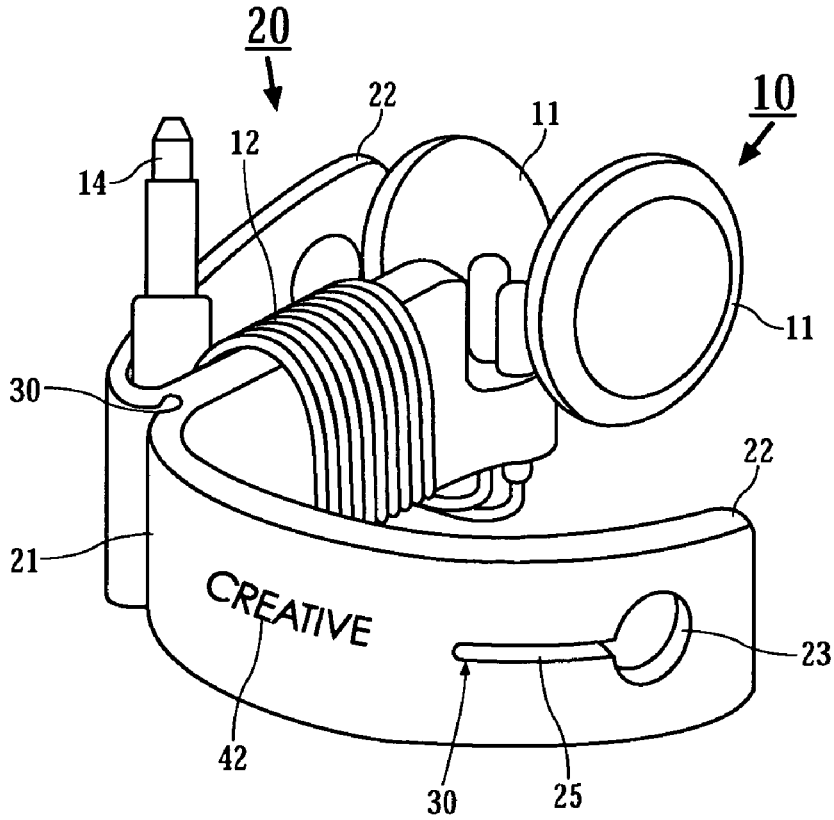
FIG. 3 illustrates in detail the auxiliary device coiled around the cable coiling apparatus of FIG. 2.
Figure 3:
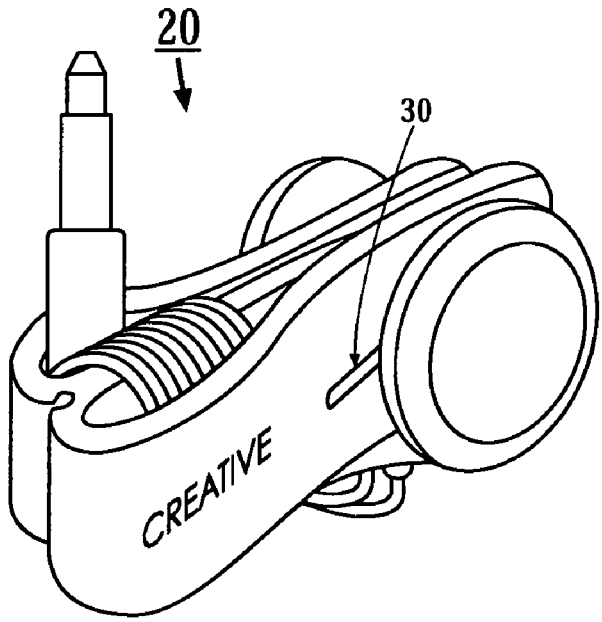

As shown in FIG. 3, the cable 12 is coiled around the first portion 24 of the cable strap 21. Each of the ends 22 is folded over to show a secondary logo 42 printed on the cable strap 21. The secondary logo 42 may be printed by a process such as, for example, silk screen printing. The secondary logo 42 may also be indented or embossed onto the cable strap 21. The joint 30 prevents the cable strap 21 from separating during the folding of the ends 22. Each of the earphones 11 are passed through the slot 23, the cable strap 21 enabling the slit 25 to stretch from a closed state 31, thereby enlarging the slot 23 to receive each earphone 11.

After each of the earphones 11 is passed through the slot 23, the slit 25 resumes the closed state 31 to releasably secure the earphone set 10 to the apparatus 20. An advantage of the slit 25 is the slit 25 can be stretched to enlarge the slot 25 thus enabling earphones of varying sizes to be releasably secured to the apparatus 20.

The earphone set 10 therefore assumes a relatively compact configuration for ease of storage and transport.

Figure 4:
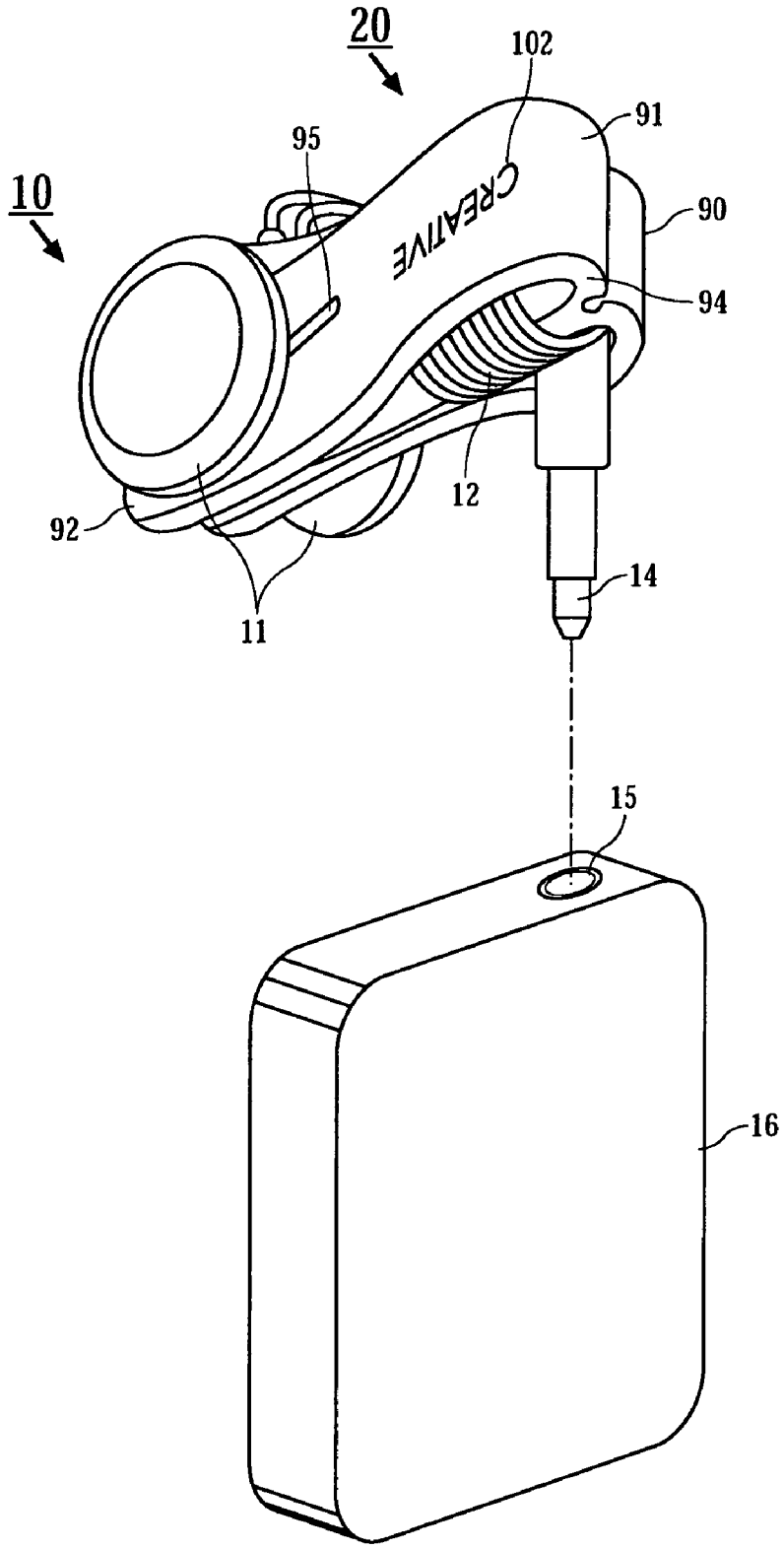
FIG. 4 shows the auxiliary device coiled around the apparatus of FIG. 2 for attaching to the portable device.

FIG. 4 shows an exploded assembly view of the apparatus of FIG. 3 for attaching to the portable device 16. The apparatus 20 is attached to the portable device 16 by plugging the jack 14 of the earphone set 10 into the socket 15 of the portable device 16. Thus, the practice of coiling the cable 13 of the earphone set 10 around the portable device 16 when a user stops listening to content of the portable device 16 becomes unnecessary with the use of the apparatus 20.

Figure 5:
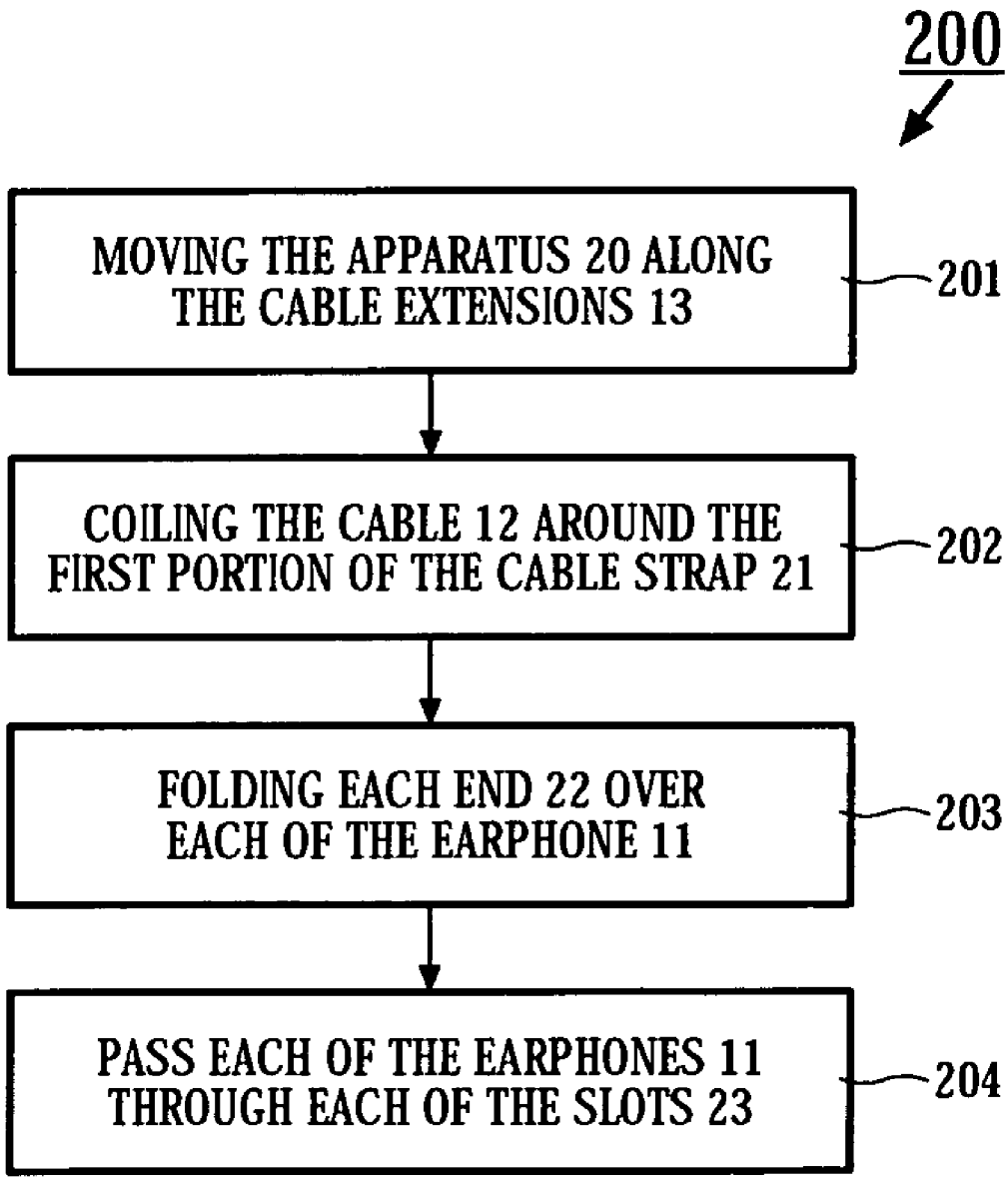
FIG. 5 is a flow chart showing a method according to the first preferred embodiment.

FIG. 5 is a flow chart illustrating a method 200 for releasably securing the earphone set 10 to the apparatus 20 according to the first embodiment so that the earphone set 10 is in a relatively compact configuration for ease of storage and transport. The apparatus 20 is moved 201 along the cable extensions 13, stopping at the earphone mounts 18. Then, the cable 12 is coiled 202 around the first portion 24 of the cable strap 21 and each end 22 is folded 203 over the cable 12 to pass 204 each of the pair of earphones through the slot 23 of each of the ends 22. After releasably securing the earphone set to the apparatus 20, the jack 14 may be inserted into the socket 15 to attach the earphone set 10 to the portable device 16. Consequently, the practice of coiling the cable 13 of the earphone set 10 around the portable device 16 when a user stops listening to content of the portable device 16 becomes unnecessary with the use of the apparatus 20.

Figure 6:
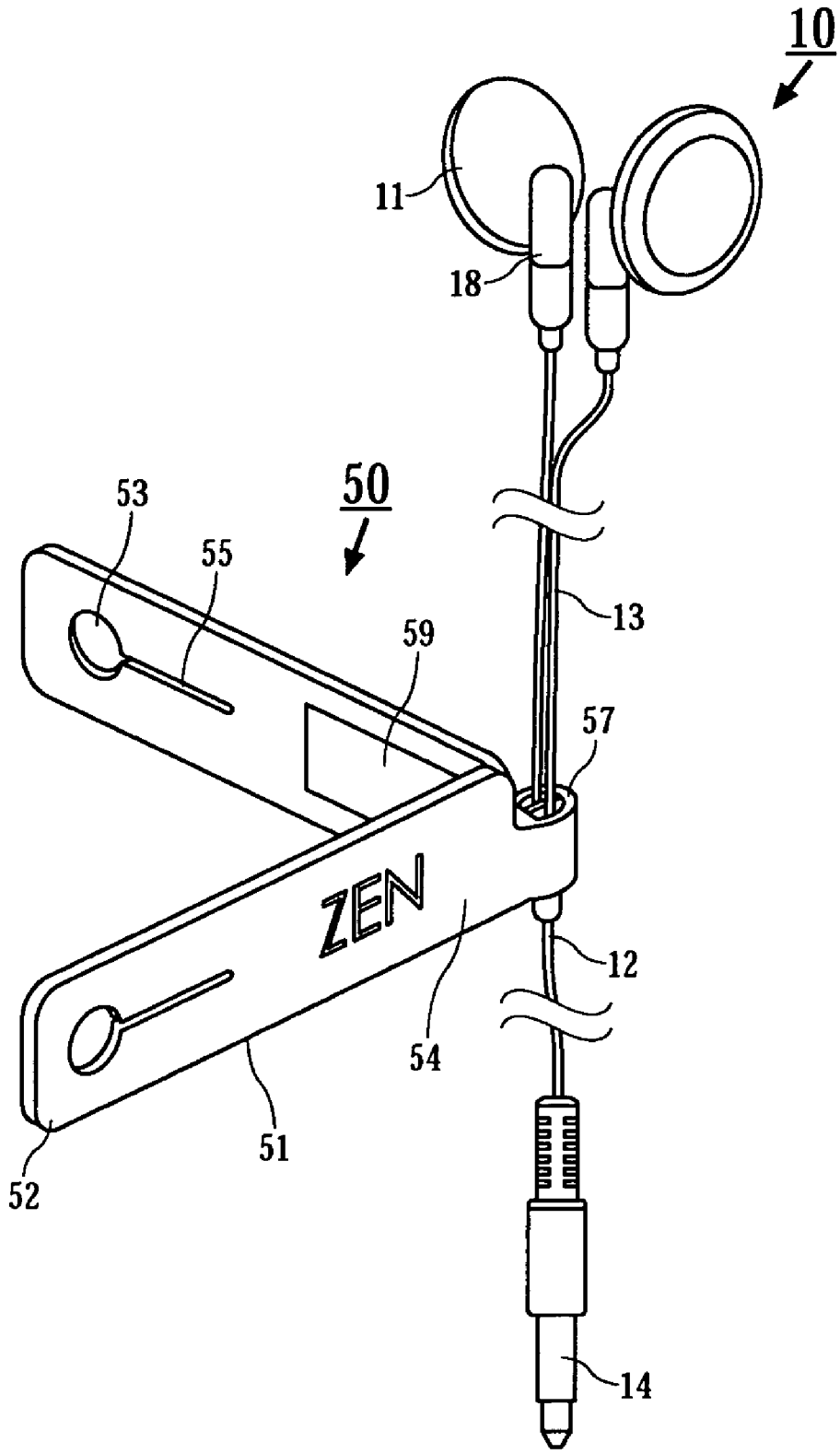
FIG. 6 shows a perspective view of a cable coiling apparatus according to a second preferred embodiment.

FIG. 6 shows a cable coiling apparatus 50 for releasably securing the earphone set 10 to the apparatus 50 according to a second embodiment of the invention so that the earphone set 10 is in a relatively compact configuration for ease of storage and transport. The apparatus 50 comprises a cable strap 51 for coiling the cable 12 around a first portion 54 of the cable strap 51.

The cable strap 51 is detachably attached by a fastening device 59. The strap 51 provides two ends 52, each end 52 comprising a slot 53. The fastening device 59 may be, for example, Velcro, press-studs, zips or snap fasteners. The slot 53 comprises a slit 55 extending adjacent from the slot 53. The slot 53 may be of a shape such as, for example, a circle (as shown), a triangle, a quadrilateral, a polygon and the like. The slit 55 may be of a shape such as, for example a horizontal cut-out. The cable strap 51 may be made of an elastic material such as, for example, leather, vinyl, butyl, neoprene or any suitable types of polymers. The cable strap 51 comprises a sleeve 57 for securing the cable 12. The sleeve 57 may be sized to prevent the apparatus 50 from moving down towards the jack 14. Alternatively, the sleeve 57 may have an adjustable diameter to allow the passage of cables of different thickness. A first logo 60 may be printed onto the first portion 54. The first logo 60 may be printed by a process such as, for example, silk screen printing. The first logo 60 may also be indented or embossed onto the first portion 54 of the apparatus 50.

The apparatus 50 may be attached to the earphone set 10 during the manufacture of the earphone set 10.

Figure 7:
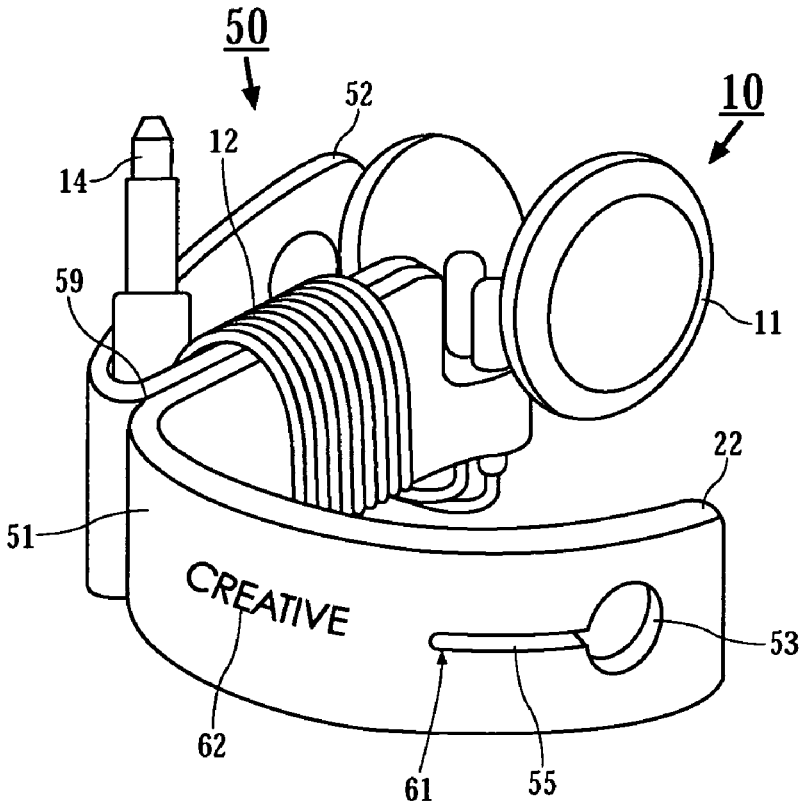
FIG. 7 illustrates in detail the auxiliary device coiled around the cable coiling apparatus of FIG. 6.
Figure 7:
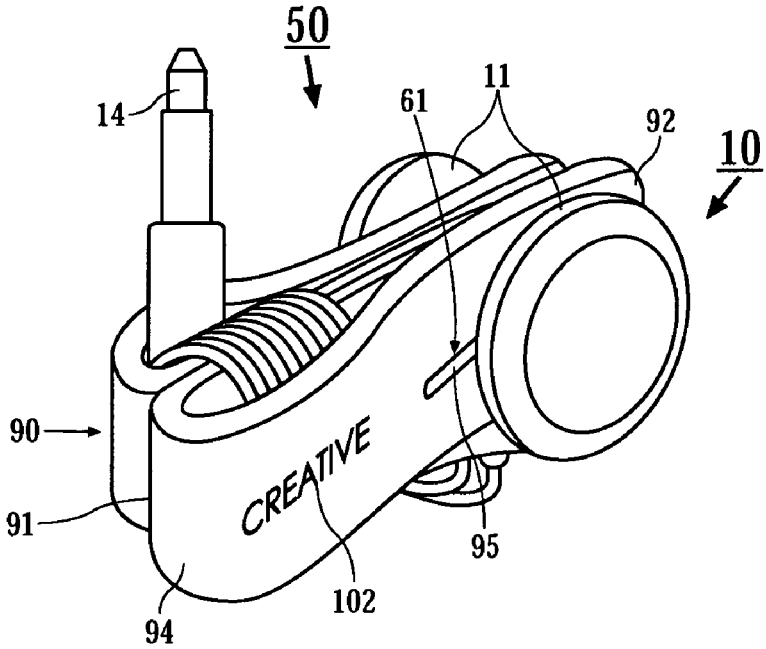

As shown in FIG. 7, the ends 52 are detachably attached via the fastening device 59 and the cable 12 is coiled around the cable strap 51. Each end 52 is folded over the cable 12 to show a second logo 62 printed on the cable strap 51. The second logo 42 may also be indented or embossed onto the cable strap 51. Each of the earphones 11 are inserted through the slot 53, the cable strap 51 enabling the slit 55 to stretch from a closed state 61, thereby enlarging the slot 53 to receive each earphone 11. The earphone set 10 is thus compactly secured to the apparatus 50. After each of the earphones 11 is inserted through the slot 23, the slit 55 resumes the closed state 61 to attach the earphone set 10 to the apparatus 50.

Figure 8:
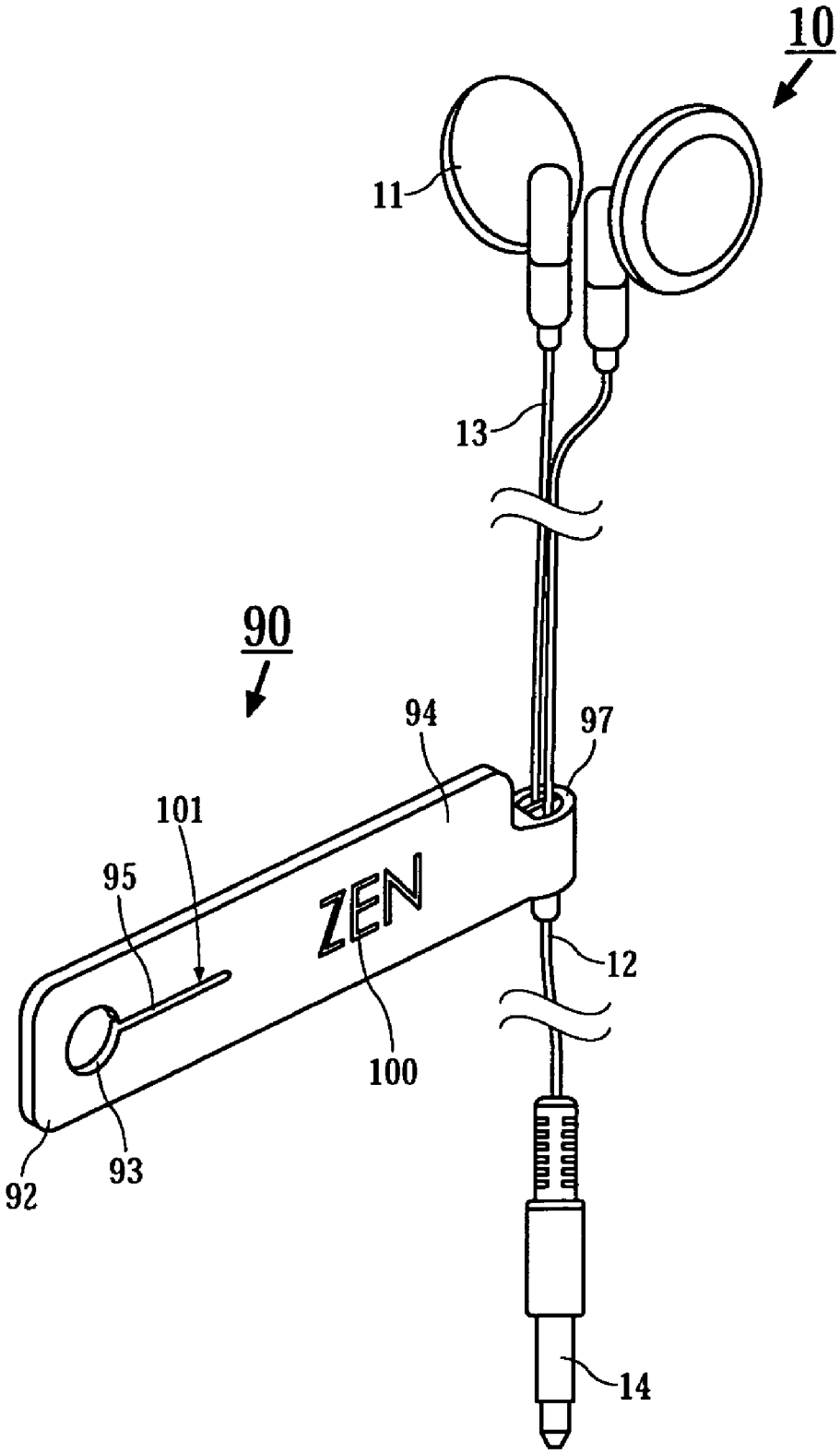
FIG. 8 shows a perspective view of a cable coiling apparatus according to a third preferred embodiment.

FIG. 8 shows a cable coiling apparatus 90 for releasably securing the earphone set 10 to the cable coiling apparatus 90 according to a third embodiment of the invention so that the earphone set 10 is in a relatively compact configuration for ease of storage and transport. The apparatus 90 comprises a cable strap 91 for coiling the cable 12 around a first portion 94 of the cable strap 91. The cable strap 91 comprises a slot 93 at a first end 92 of the cable strap 91.

The slot 93 comprises a slit 95 extending adjacent from the slot 93. The slot 93 may be of a shape such as, for example, a circle (as shown), a triangle, a quadrilateral, a polygon and the like. The slit 95 may be of a shape such as, for example a horizontal cut-out. The cable strap 91 may be made of an elastic material such as, for example, leather, vinyl, butyl, neoprene or any suitable types of polymers. The cable strap 91 comprises a sleeve 97 for securing the cable 12. The sleeve 97 may be sized to prevent the apparatus 90 from moving down towards the jack 14. An indicia may be printed onto the first portion 94. The first indicia may be printed by a process such as, for example, silk screen printing. The first indicia may also be indented or embossed onto the first portion 94 of the apparatus 90.

The apparatus 90 may be attached to the earphone set 10 during the manufacture of the earphone set 10.

Figure 9:
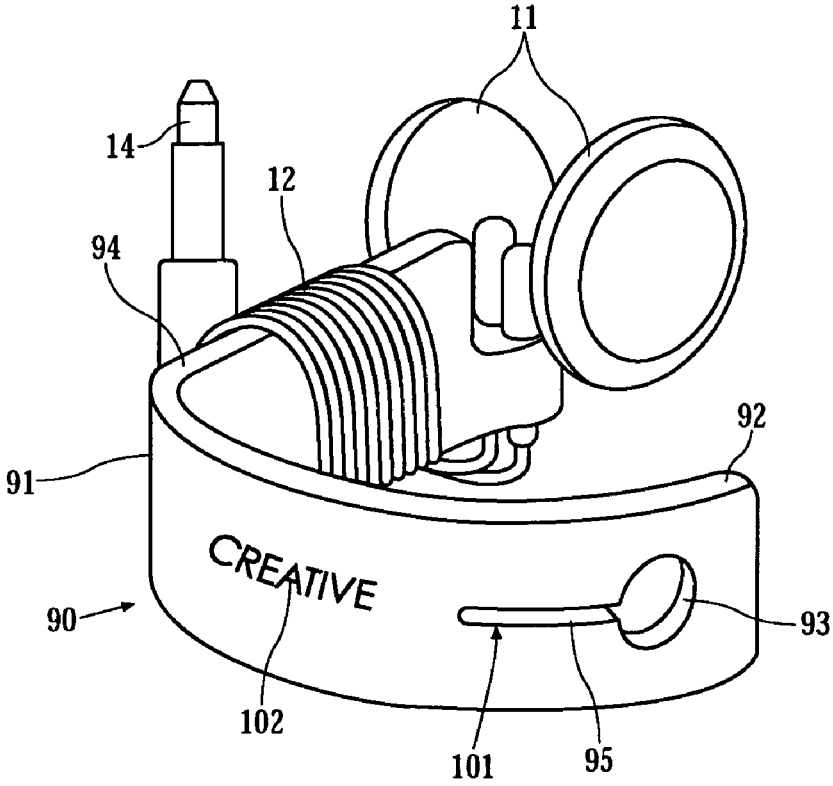
FIG. 9 illustrates in detail the auxiliary device coiled around the cable coiling apparatus of FIG. 8.
Figure 9:
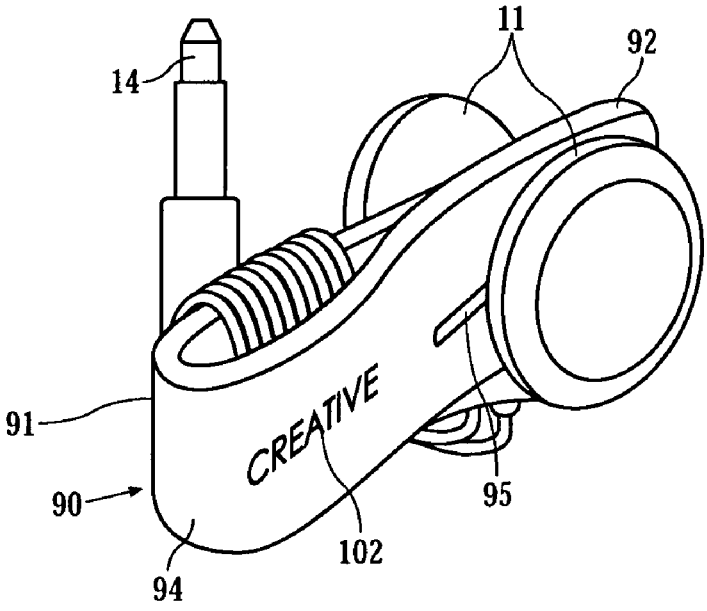

As shown in FIG. 9, the cable 12 is coiled around the cable strap 91. The first end 92 is folded over the cable 12 to show a second indicia 102 printed on the cable strap 91. The second indicia 102 may also be indented or embossed onto the cable strap 91. Each of the earphones 11 are inserted through the slot 93, the elastic nature of the cable strap 91 enabling the slit 95 to stretch from a closed state 101, thereby enlarging the slot 93 to receive each earphone 11. After, the earphone set 10 is attached to the apparatus 90. After each of the earphones 11 is inserted through the slot 93, the slit 95 resumes the closed state 101 to releasably secure the earphone set 10 to the apparatus 90.

Figure 10:
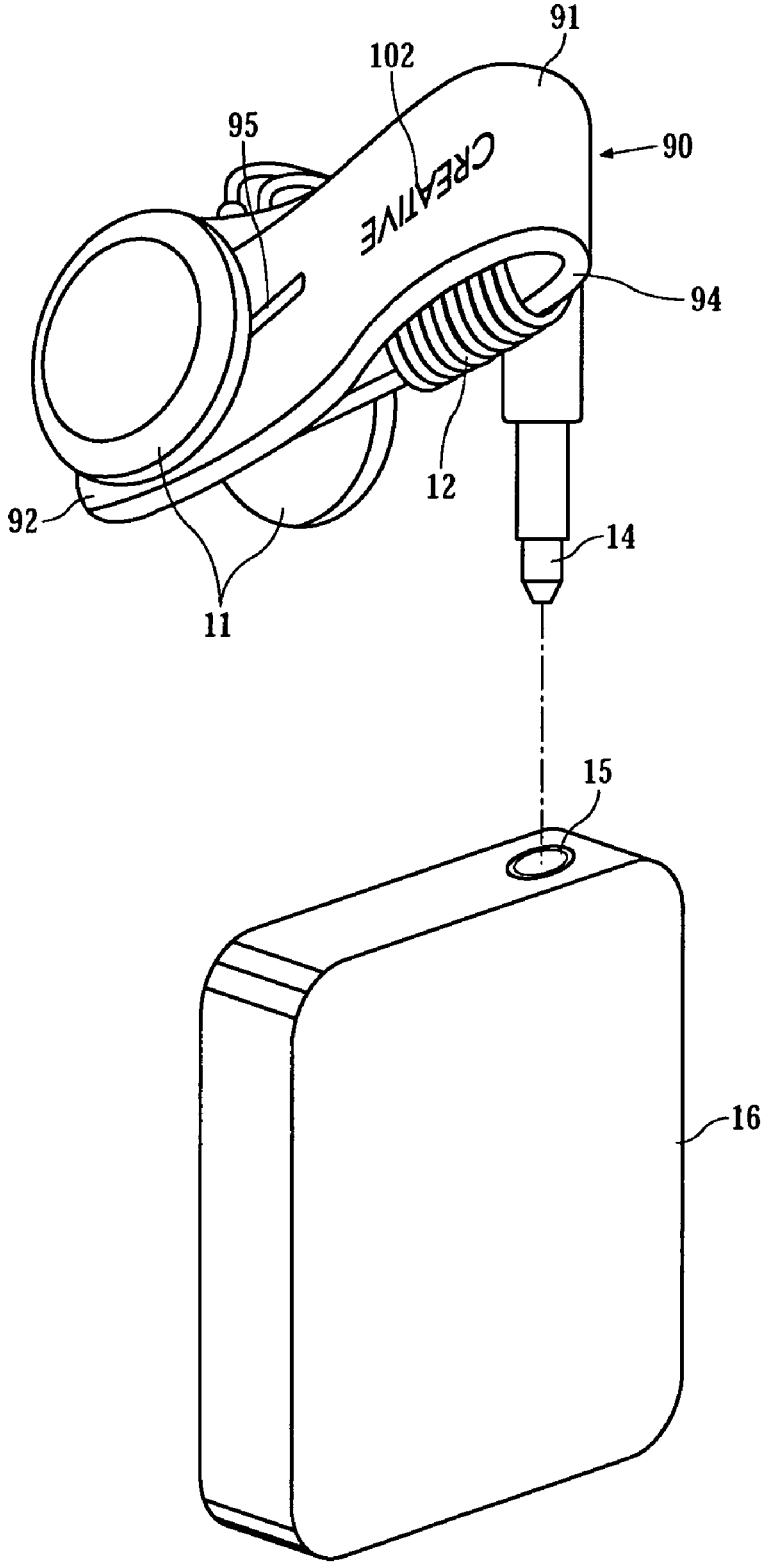
FIG. 10 shows the auxiliary device coiled around the apparatus of FIG. 8 for attaching to the portable device.
Figure 11:
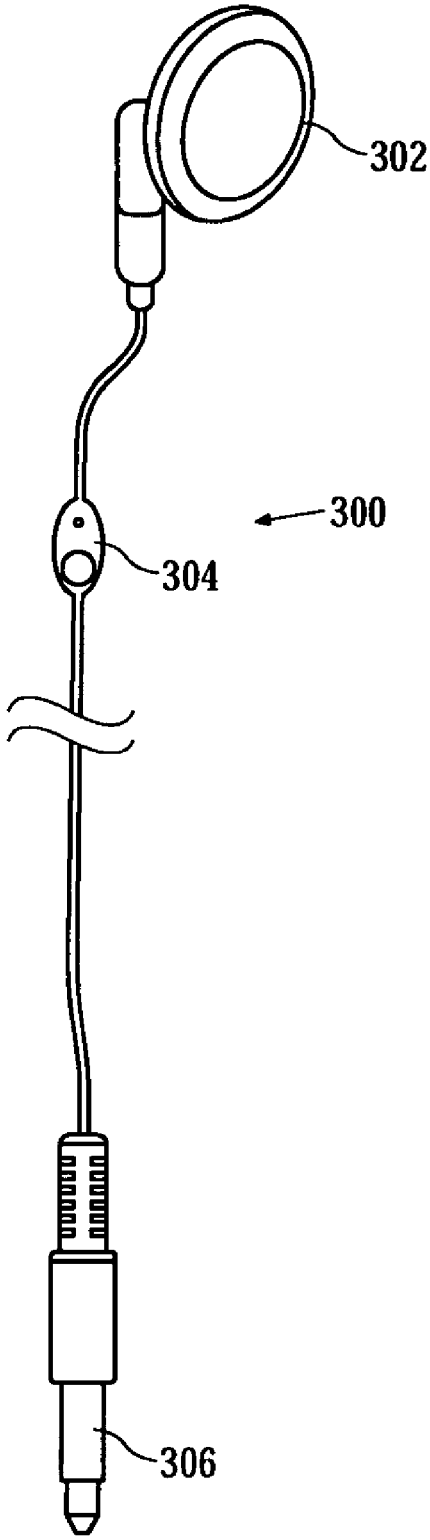
FIG. 11 shows an alternative form of an earphone set.

FIG. 10 shows an exploded assembly view of the apparatus 90 of FIG. 8 for attaching to the portable device 16. The apparatus 90 is attached to the portable device 16 by plugging the jack 14 of the earphone set 10 into the socket 15 of the portable device 16. It is to be noted that the third embodiment may also be used for single earphone such as, for example, those used in hands-free kits 300 of mobile telephones as shown in FIG. 11 with primary components of at least one earphone 302, at least one microphone 304, and a jack 306

Whilst there has been described in the foregoing description preferred embodiments of the present invention, it will be understood by those skilled in the technology concerned that many variations or modifications in details of design or construction may be made without departing from the present invention.

The invention claimed is:

1. A method for coiling an earphone set comprising at least one earphone, at least one wire for each earphone, and a connector, the method comprising:

coiling the at least one wire around a cable strap having at least one end segment at a first end of the cable strap; and passing a first end segment of the first end of the cable strap over a first earphone by passing the first earphone through a first slot in the first end segment for releasably attaching the first earphone to the cable strap.

2. The method according to claim 1, further comprising:

passing a second end segment of the first end of the cable strap over a second earphone by passing the second earphone through a second slot in the second end segment for releasably attaching the second earphone to the cable strap.

3. The method according to claim 2, wherein each slot comprises a slit extending from each slot, each slit being for enabling expansion of each slot.

4. The method according to claim 3, wherein each slot has a defined shape selected from the group consisting of a circle, a triangle, a quadrilateral, and a polygon.

5. Apparatus for coiling an earphone set comprising at least one earphone, at least one wire for each earphone, and a connector, the apparatus comprising:

a cable strap for coiling the at least one wire, the cable strap comprising at least one end segment at a first end of the cable strap;

a first end segment of the first end of the cable strap having a first slot for passing over a first earphone of the at least one earphone by passing the first earphone through the first slot for attaching the first earphone to the cable strap; and a second end segment of the first end of the cable strap having a second slot for passing over a second earphone of the at least one earphone by passing the second earphone through the second slot for attaching the second earphone to the cable strap;

wherein the earphone set is releasably secured to the apparatus after the at least one wire is coiled.

6. The apparatus according to claim 5, wherein the cable strap is of an elastic material selected from the group consisting of vinyl, leather, butyl, and neoprene.

7. The apparatus according to claim 5, wherein each slot comprises a slit extending from each slot, the slit being for enabling expansion of each slot.

8. The apparatus according to claim 7, wherein each slot has a defined shape selected from the group consisting of a circle, a triangle, a quadrilateral, and a polygon.

9. The apparatus according to claim 5, wherein the first end segment is detachably attached to the second end segment via a fastening device selected from the group consisting of hooks, loops, press-studs, zips and snaps.

10. The apparatus according to claim 9, wherein the first end segment is affixed to the second end segment.

11. The apparatus according to claim 5, wherein the cable strap comprises a sleeve for securing the wires.

12. The apparatus according to claim 11, wherein the cable strap is configured to affix the earphone set to it.

13. The apparatus according to claim 11, wherein the cable strap is configured to detachably attach the earphone set to it.

14. The apparatus of claim 11, further comprising:

a rib within the sleeve to prevent the cable strap from moving towards the connector.

15. An apparatus for coiling an earphone set having at least one earphone, a wire for each earphone, and a connector, the apparatus comprising:

a first portion for coiling the wire; an end having a slot configured for passing the earphone through the slot;

a second end having a second slot configured for passing a second earphone through the second slot; and a sleeve for passing the wire through.

16. The apparatus of claim 15, wherein the sleeve is positioned between the first end and the second end.

* * * * *